US009639019B2

(12) United States Patent
Kano et al.

(10) Patent No.: US 9,639,019 B2
(45) Date of Patent: May 2, 2017

(54) CLEANING MEMBER, IMAGE HOLDER DEVICE, AND CHARGING DEVICE

(71) Applicant: FUJI XEROX CO., LTD., Tokyo (JP)

(72) Inventors: Fuyuki Kano, Kanagawa (JP); Minoru Rokutan, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/886,625

(22) Filed: Oct. 19, 2015

(65) Prior Publication Data

US 2016/0378013 A1 Dec. 29, 2016

(30) Foreign Application Priority Data

Jun. 24, 2015 (JP) ..... 2015-126949

(51) Int. Cl.
*G03G 15/02* (2006.01)

(52) U.S. Cl.
CPC ..... *G03G 15/0258* (2013.01)

(58) Field of Classification Search
CPC ..... G03G 15/0225; G03G 15/0258; G03G 21/0058; G03G 2221/0047
See application file for complete search history.

(56) References Cited

U.S. PATENT DOCUMENTS 4,870,465 A * 9/1989 Lindblad ..... G03G 21/0005 399/347
2011/0170901 A1* 7/2011 Kawai ..... G03G 21/0058 399/100
2011/0318047 A1* 12/2011 Nonaka ..... G03G 15/0225 399/100
2012/0002998 A1 1/2012 Kawai
2012/0076529 A1* 3/2012 Kawahara ..... G03G 15/0258 399/100
2012/0076530 A1 3/2012 Aoyagi et al.
2013/0089354 A1* 4/2013 Kano ..... G03G 15/0225 399/100

FOREIGN PATENT DOCUMENTS

JP 2012-014011 A 1/2012
JP 2012-068569 A 4/2012

* cited by examiner

*Primary Examiner* — Sandra Brase
(74) *Attorney, Agent, or Firm* — Sughrue Mion, PLLC

(57) ABSTRACT

Provided is a cleaning member including a helical convex section formed on an outer peripheral surface, wherein the cleaning member comes into complete contact with a target cleaning member in an axial direction of the target cleaning member, and rotates in contact with the target cleaning member rotating around an axis.

9 Claims, 7 Drawing Sheets

CLEANING MEMBER, IMAGE HOLDER DEVICE, AND CHARGING DEVICE

CROSS-REFERENCE TO RELATED APPLICATIONS

This application is based on and claims priority under 35 USC 119 from Japanese Patent Application No. 2015-126949 filed Jun. 24, 2015

BACKGROUND

Technical Field

The present invention relates to a cleaning member, an image holder device, and a charging device.

SUMMARY

According to an aspect of the invention, there is provided a cleaning member including:

a helical convex section formed on an outer peripheral surface, wherein the cleaning member comes into complete contact with a target cleaning member in an axial direction of the target cleaning member, and rotates in contact with the target cleaning member rotating around an axis.

BRIEF DESCRIPTION OF THE DRAWINGS

Exemplary embodiments of the present invention will be described in detail based on the following figures, wherein.

DETAILED DESCRIPTION

An example of an image holder device according to the exemplary embodiment of the invention, a charging device according to the exemplary embodiment of the invention, and an image forming apparatus that includes the image holder device according to the exemplary embodiment of the invention and the charging device according to the exemplary embodiment of the invention will be described with reference to FIGS. 1A to 7B. Moreover, arrow H indicates an upward and downward direction (vertical direction), arrow W indicates an apparatus width direction (horizontal direction), and arrow D indicates an apparatus depth direction (horizontal direction) which are shown in the views.

Entire Configuration

Figure 5:
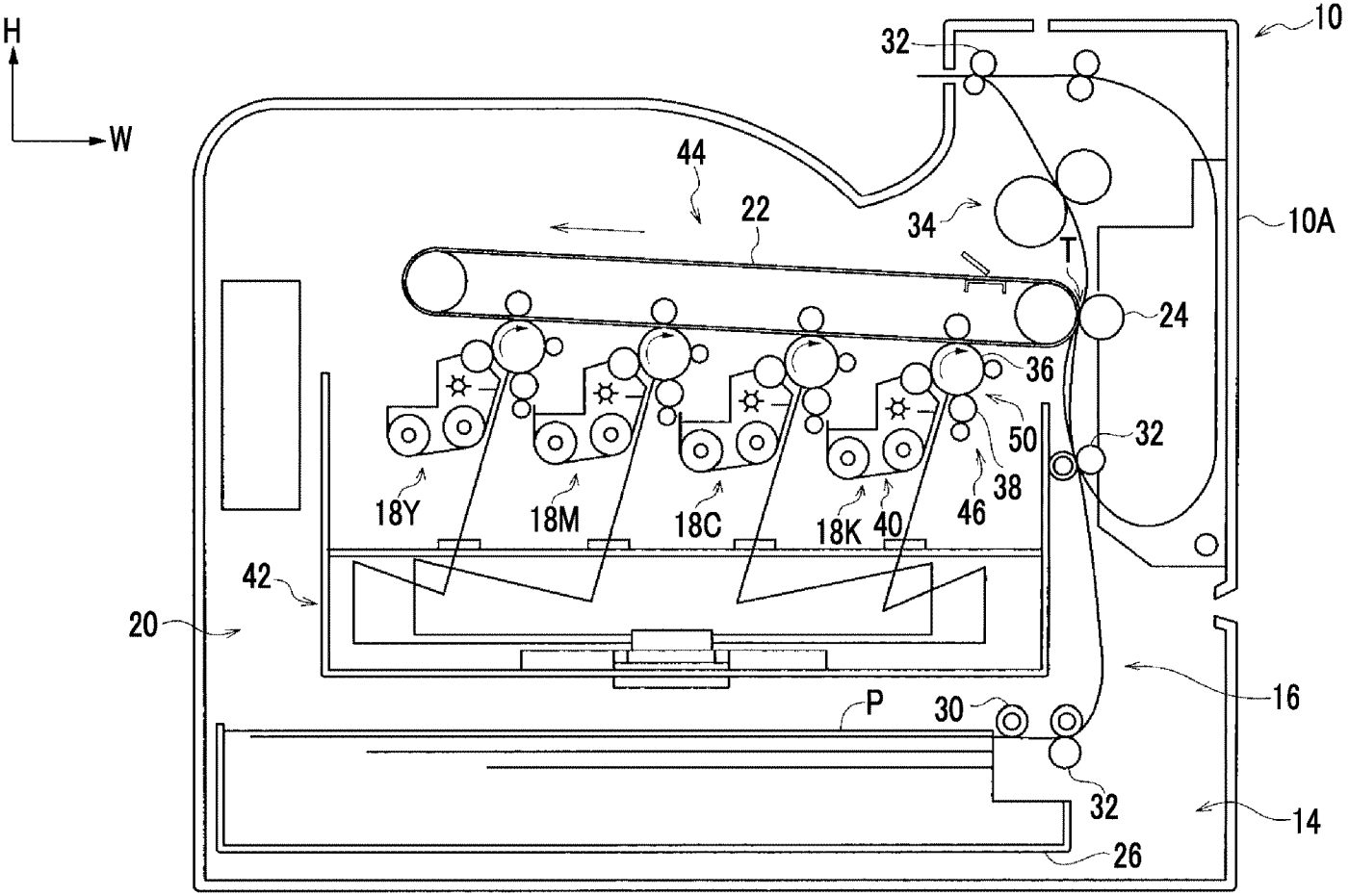
FIG. 5 is a schematic configuration view illustrating an image forming apparatus that includes the image holder device according to the exemplary embodiment of the invention and the charging device according to the exemplary embodiment of the invention.

As illustrated in FIG. 5, an image forming apparatus 10, which includes the image holder device according to the present exemplary embodiment and the charging device according to the present exemplary embodiment, includes a storage section 14 in which a sheet member P as a recording medium is stored, a transport section 16 that transports the sheet member P stored in the storage section 14, and an image forming section 20 that performs image forming onto the sheet member P transported by the transport section 16 from the storage section 14 in this order from a lower part to an upper part in the upward and downward direction (arrow H direction).

Storage Section

The storage section 14 includes a storage member 26 that can be pulled out on a front side in the apparatus depth direction from an apparatus body 10A of the image forming apparatus 10 and the sheet members P are stacked in the storage member 26. Furthermore, the storage section 14 includes a delivery roll 30 that delivers the sheet member P stacked in the storage member 26 to a transport path (not illustrated) configuring the transport section 16.

Transport Section

The transport section 16 includes plural transport rolls 32 that transport the sheet member P along the transport path.

Image Forming Section

The image forming section 20 includes four image forming units 18Y, 18M, 18C, and 18K of yellow (Y), magenta (M), cyan (C), and black (K). Moreover, in the following description, description will be given by omitting Y, M, C, and K when there is no need for them to be described by distinguishing Y, M, C, and K.

Furthermore, the image forming section 20 includes an exposure device 42 that is provided for irradiating an image holder 36 of an image holder device 50 provided in the image forming unit 18 of each color with exposure light of each color.

Furthermore, the image forming unit 18 of each color includes the image holder 36 described above and a charging roll 38 of a charging device 46 for charging a surface of the image holder 36. Furthermore, the image forming unit 18 includes a developing device 40 for visualizing an electrostatic latent image as a toner image by developing the electrostatic latent image formed by exposing the surface of the image holder 36 which is charged by the exposure device 42 described above.

Furthermore, the image forming section 20 includes an endless transfer belt 22 onto which the toner images formed by the image forming unit 18 of each color are collectively transferred and a transfer roll 24 that transfers the toner image transferred onto the transfer belt 22 onto the sheet member P.

Furthermore, the image forming section 20 includes a fixing device 34 that fixes the toner image onto the sheet member P by heating and pressurizing the toner image on the sheet member P.

As described above, a forming device 44 for forming the image on an outer peripheral surface of the charged image holder 36 is configured to include the developing device 40, the transfer belt 22, and the transfer roll 24.

Moreover, the image holder device 50 and the charging device 46 will be described in detail later.

Operation of Image Forming Apparatus

The image is formed in the image forming apparatus 10 as follows.

First, the charging roll 38 of each color to which a voltage is applied uniformly and negatively charges the surface of the image holder 36 by coming into contact with the surface of the image holder 36 of each color in a predetermined potential. Subsequently, the exposure device 42 forms the electrostatic latent image by irradiating the charged surface of the image holder 36 of each color with the exposure light based on data input from the outside.

Thus, the electrostatic latent image corresponding to image data is formed on the surface of each image holder 36. Furthermore, the developing device 40 of each color develops the electrostatic latent image and visualizes the electrostatic latent image as the toner image. Furthermore, the toner image formed on the surface of the image holder 36 of each color is transferred onto the transfer belt 22.

Thus, the sheet member P that is delivered by the delivery roll 30 from the storage member 26 to the transport path is delivered to a transfer position T in which the transfer belt 22 comes into contact with the transfer roll 24. The toner image of a surface of the transfer belt 22 is transferred onto the sheet member P in the transfer position T by transporting the sheet member P by clamping the sheet member P between the transfer belt 22 and the transfer roll 24.

The toner image transferred onto the sheet member P is fixed to the sheet member P by the fixing device 34. Then, the sheet member P to which the toner image is fixed is discharged to the outside of the apparatus body 10A by the transport roll 32.

Main Portion Configuration

Configuration of Image Holder Device

Next, a configuration of the image holder device 50 will be described.

Figure 4:
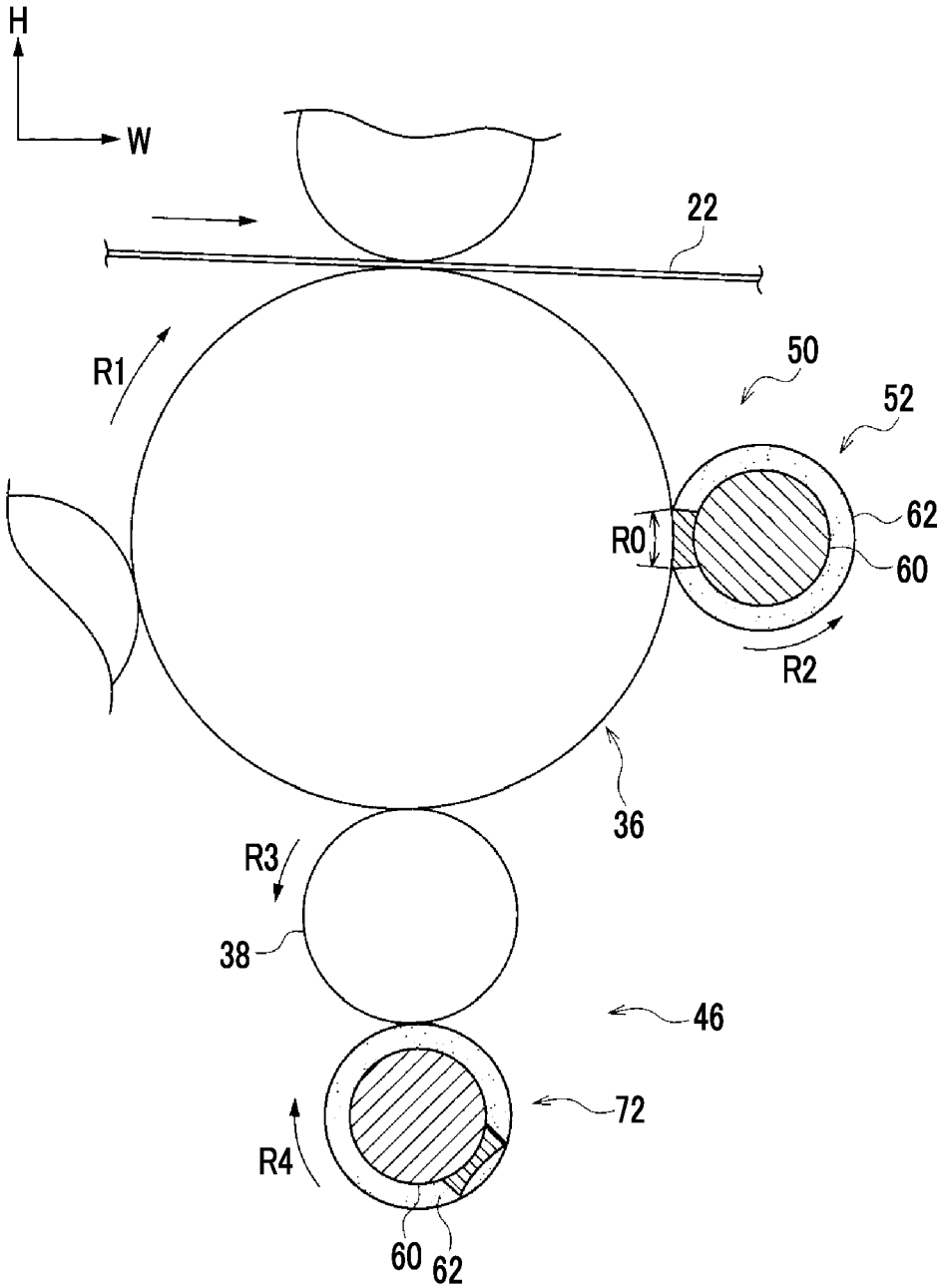
FIG. 4 is a sectional view illustrating the image holder device and a charging device of the exemplary embodiment of the invention.

As illustrated in FIG. 4, the image holder device 50 includes the image holder 36 that rotates in an arrow R1 direction and a cleaning member 52 that comes into contact with the image holder 36 and cleans the outer peripheral surface of the image holder 36 while rotating by being driven by the rotating image holder 36.

Furthermore, the image holder device 50 includes support members 56 (see FIG. 3) as bearings supporting the cleaning member 52 to be rotatable.

Support Member

Figure 3:
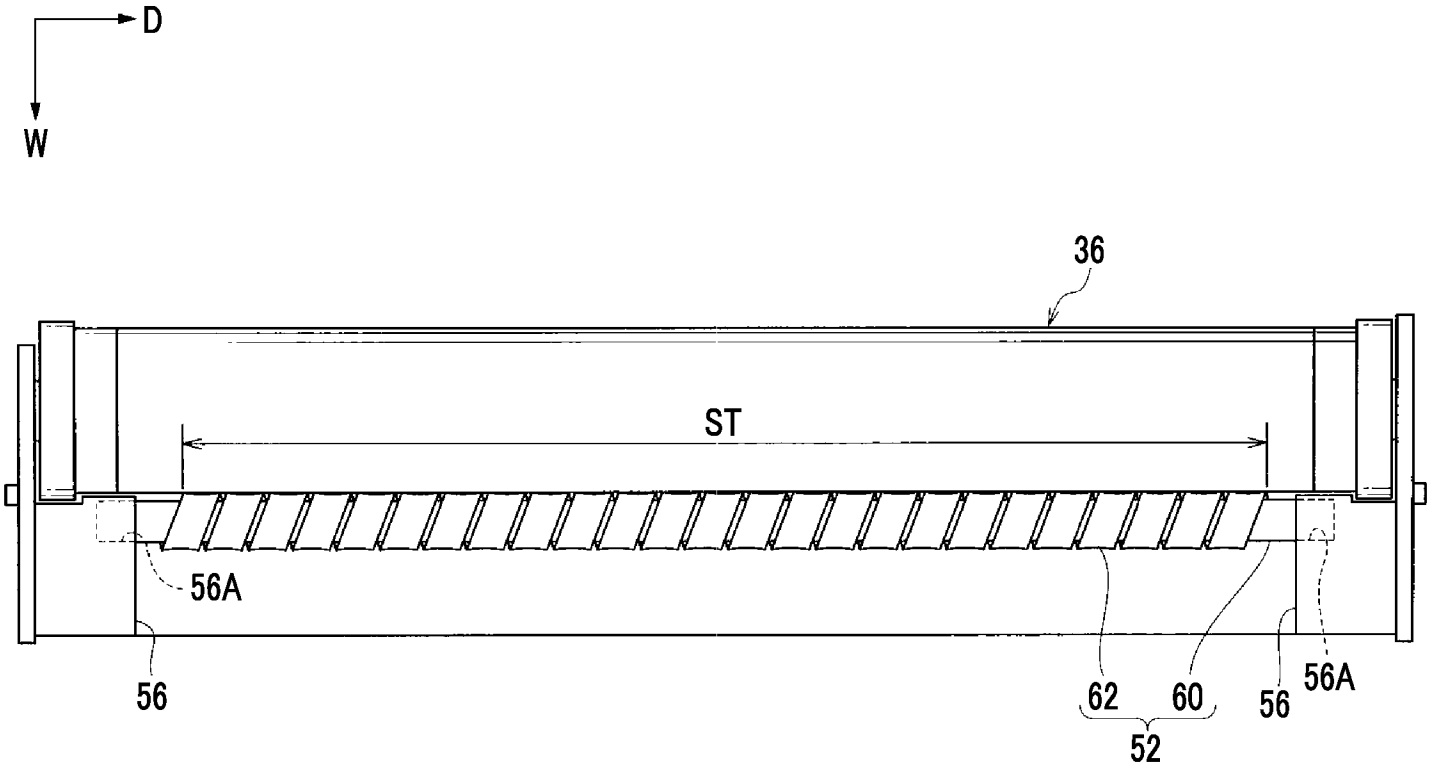
FIG. 3 is a front view illustrating an image holder device according to the exemplary embodiment of the invention.

As illustrated in FIG. 3, the support members 56 are respectively disposed on both ends of the cleaning member 52 extending in the right and left direction in the view. The support member 56 is formed of resin material (for example, polyacetal (POM)). Then, a cylindrical concave section 56A supporting the cleaning member 52 (shaft member 60) while sliding to be rotatable is formed in each of the support members 56.

Cleaning Member

Figure 2A:
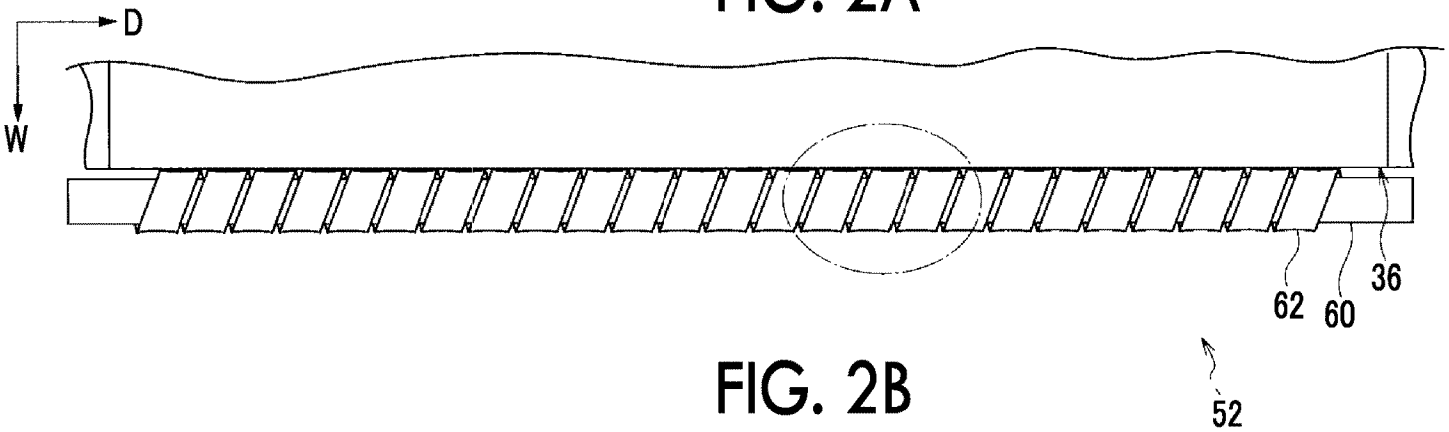
FIGS. 2A and 2B are respectively a front view and an enlarged front view illustrating the cleaning member according to the exemplary embodiment of the invention.
Figure 2B:
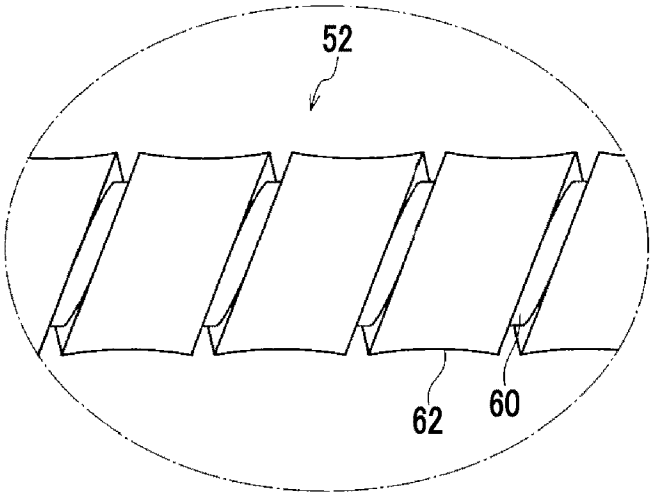

As illustrated in FIGS. 2A and 2B, the cleaning member 52 includes the cylindrical shaft member 60 extending along a direction (right and left direction in the view) of a rotation shaft of the image holder 36 and an elastic member 62 that is helically wound around the shaft member 60. In the exemplary embodiment, as an example, the elastic member 62 is formed of foam of elastically deformable urethane resin and is fixed to an outer peripheral surface of the shaft member 60 using a double-sided tape (not illustrated).

Figure 1A:
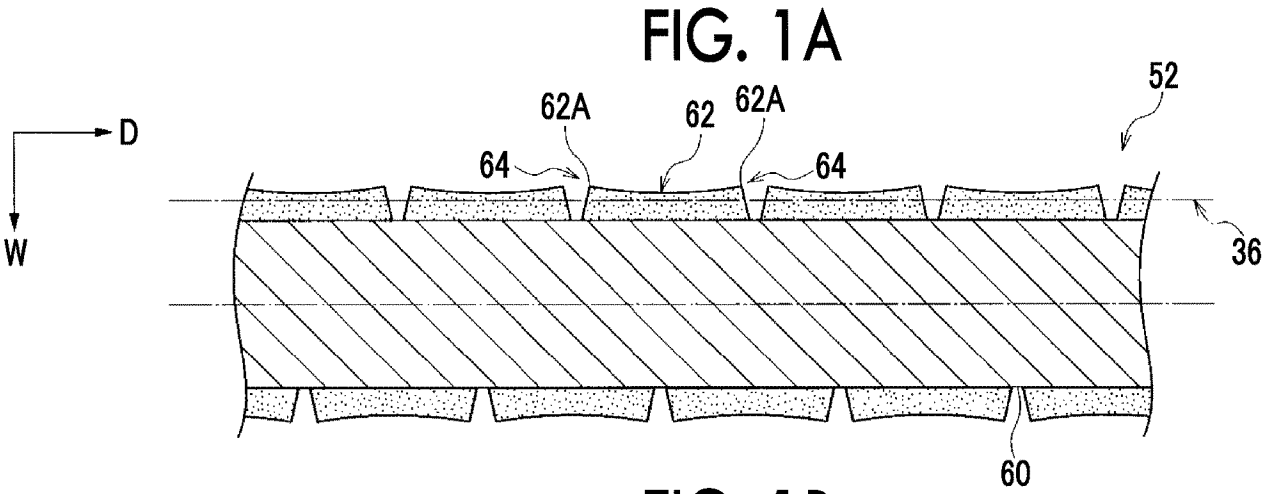
FIGS. 1A and 1B are sectional views illustrating a cleaning member of an exemplary embodiment of the invention.

Furthermore, a cross section of the elastic member 62 orthogonal to the longitudinal direction is a rectangular shape in a state before the elastic member 62 is wound around the shaft member 60. Furthermore, as illustrated in FIG. 1A, the cross section of end portions 62A of the elastic member 62 orthogonal to the longitudinal direction protrude in a radial direction (hereinafter, simply referred to as "radial direction") of the shaft member 60 more than a center portion in a state of being wound around the shaft member 60. Thus, a helical convex section 64 is formed on the outer peripheral surface of the cleaning member 52. Then, the cleaning member 52 is compressed against the outer peripheral surface of the image holder 36 in a state of mounting on the apparatus body 10A. Moreover, in a state where the elastic member 62 is not compressed against the outer peripheral surface of the image holder 36, adjacent elastic members 62 are separated from each other in an axial direction (hereinafter, referred to as "axial direction") of the shaft member 60.

On the other hand, in a state where the cleaning member 52 is mounted on the apparatus body 10A and the elastic member 62 is compressed against the outer peripheral surface of the image holder 36, the end portions 62A of both sides of the elastic member 62 are deformed so as to fall on the outside of the elastic member 62 and the elastic members 62 comes into complete contact with the image holder 36 in the axial direction (direction of the rotation shaft) of the image holder 36.

Here, in a portion in which the elastic member 62 is not compressed against the outer peripheral surface of the image holder 36, as described above, the end portions 62A of both sides of the elastic member 62 protrude in the radial direction more than the center portion. Thus, in a state where the elastic member 62 is compressed against the outer peripheral surface of the image holder 36, a contact pressure (pressing force) of the elastic member 62 becoming large and small against the image holder 36 is repeated in the axial direction.

Moreover, a circumferential length of a portion in which the elastic member 62 comes into contact with the image holder 36 in the cross section orthogonal to the axial direction is a circumferential length RO (see FIG. 4). Furthermore, a distance between the outermost point in which the elastic member 62 comes into contact with the image holder 36 on one side in the axial direction and the outermost point in which the elastic member 62 comes into contact with the image holder 36 on the other side in the axial direction is a shaft length ST (see FIG. 3). Then, a product of the circumferential length RO and the shaft length ST is an effective contact area M1. The elastic member 62 coming into complete contact with the image holder 36 in the axial direction means that an actual contact area between the elastic member 62 and the image holder 36 is 90% or more of the effective contact area M1.

As a method of obtaining the contact area, the elastic member 62 is compressed against the outer peripheral surface of the image holder 36 in a state where colored powder (for example, toner) is attached to the elastic member 62. Then, the image holder 36 is separated from the elastic member 62 and an area of powder transferred to the image holder 36 is obtained. A difference in degrees of the falling of the end portions 62A of the elastic member 62 occurs and a portion in which the elastic member 62 does not partially come into contact with the image holder 36 is formed. The contact area is obtained by reducing an area of the portion from an area (effective contact area M1) obtained from a contour of powder transferred to the image holder 36. Specifically, the contact area is obtained by image-processing an image that is obtained by imaging the surface of the image holder 36 to which powder is transferred.

Operation of Image Holder Device

An operation of the image holder device 50 will be described. Specifically, if a state where contaminants are repeatedly and continuously attached to the surface of the image holder 36 over a long period of time, a phenomenon that the contaminants attached to the surface of the image holder 36 are fixed (filming) occurs. An operation for cleaning the surface of the image holder 36 to which the contaminants are fixed will be described.

As illustrated in FIG. 4, the image holder 36 to which a rotational force of a motor (not illustrated) is transmitted rotates in an arrow R1 direction. Furthermore, the cleaning member 52 rotates in an arrow R2 direction by being driven by the rotating image holder 36 in the arrow R1 direction.

Here, as described above, a contact pressure of the elastic member 62 becoming large and small against the image holder 36 is repeated in the axial direction. Furthermore, since the elastic member 62 is helically wound around the shaft member 60, a portion having a high contact pressure and a portion having a low contact pressure are moved in the axial direction by rotation of the cleaning member 52.

Thus, a force becoming large and small for separating the contaminants (fixed matters) fixed (filming) to the outer peripheral surface of the image holder 36 from the outer peripheral surface of the image holder 36 is repeated. Thus, the cleaning member 52 separates the contaminants fixed to the outer peripheral surface of the image holder 36 from the image holder 36. As described above, the cleaning member 52 cleans the outer peripheral surface of the image holder 36.

Evaluation

Next, since the cleaning member 52 according to the example and a cleaning member 200 according to a comparison example are evaluated, the evaluations will be described. The cleaning member 52 and the cleaning member 200 are the same as each other except the following articles.

Evaluation Specification (1) The cleaning members 52 and 200 are produced by helically winding the elastic member 62 of a thickness of 3.0 [mm] and a width of 15 [mm] on the shaft member 60 (material=SUM24EZ, outer diameter=ϕ 5.0 mm, and entire length=338.3 mm) using a double-sided tape (manufactured by Nitto Denko Co., No 5605).

The cleaning members 52 and 200 are mounted on the image forming apparatus (manufactured by Fuji Xerox Co., Ltd. ApeosPort V7775). A compression amount in the cleaning members 52 and 200 which is compressed by the outer peripheral surface of the image holder 36 is 0.5 [mm] in the center portion of the elastic member 62 in the width direction. The compression amount in the center portion of the elastic member 62 in the width direction is 0.5 [mm] and thereby the force for compressing the image holder 36 in the center portion of the elastic member 62 in the width direction is 0.1 [N] or more.

Figure 1B:
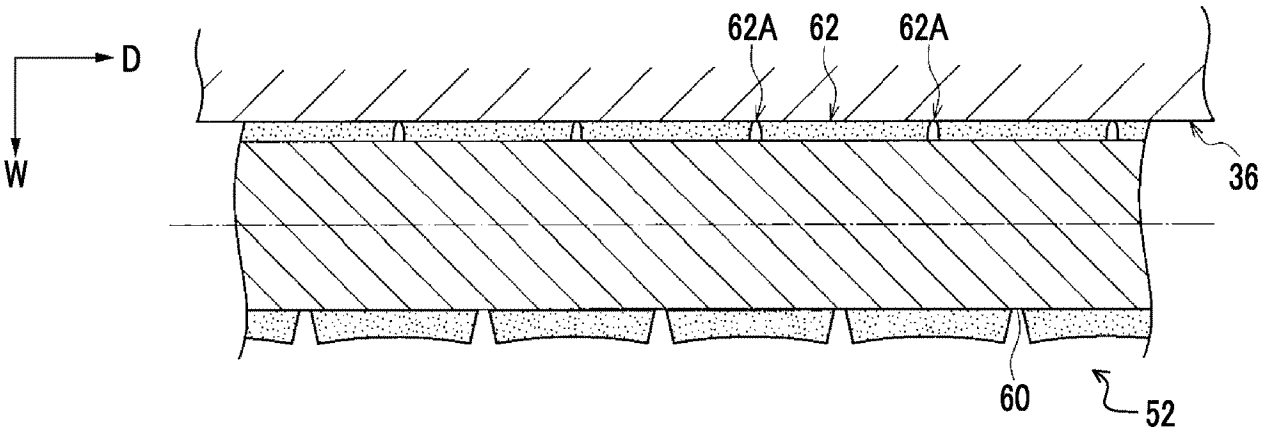

Furthermore, as illustrated in FIG. 1B, for the cleaning member 52, the elastic member 62 came into complete contact with the image holder 36 in the width direction in a state where the elastic member 62 is compressed against the outer peripheral surface of the image holder 36 (see FIG. 1B). The contact area of the cleaning member 52 is 95 [%].

Figure 6:
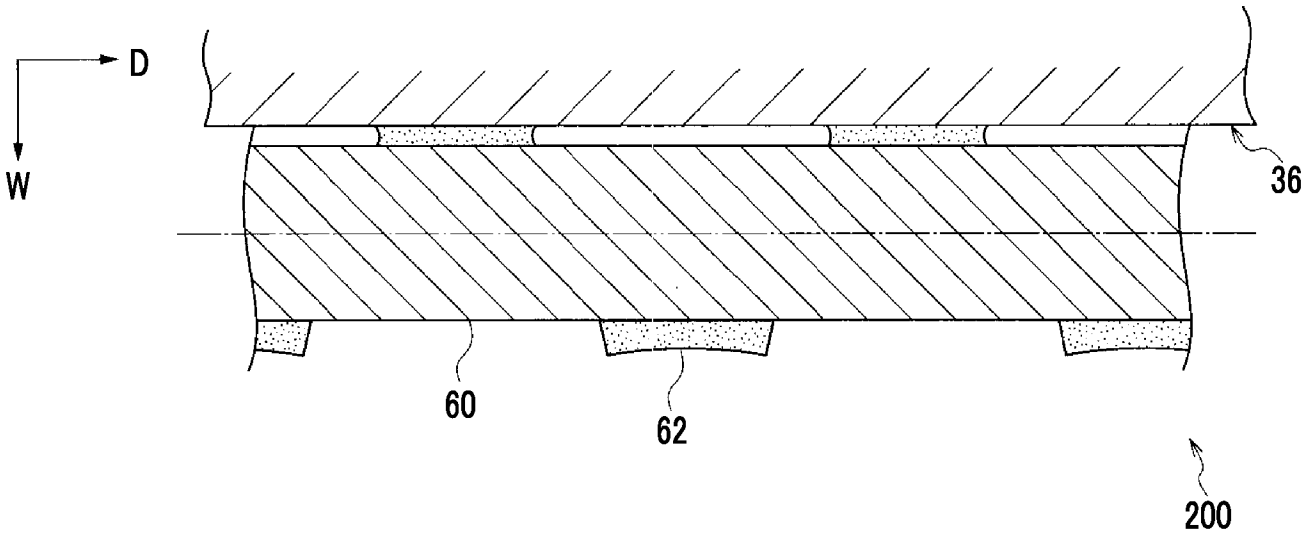
FIG. 6 is a sectional view illustrating the cleaning member according to a comparison example of the invention.

On the other hand, as illustrated in FIG. 6, for the cleaning member 200, the adjacent elastic members 62 are separated with respect to the image holder 36 in the axial direction in a state where the elastic member 62 is compressed against the outer peripheral surface of the image holder 36. The contact area of the cleaning member 200 is 32 [%].

Evaluation Test and Evaluation Articles 50,000 sheets of a black image pattern of an image density of 50% are printed on the sheet members P (J papers manufactured by Fuji Xerox Co., Ltd.) of A4 size using the image forming apparatus on which the cleaning member 52 is mounted and the image forming apparatus on which the cleaning member 200 is mounted under an environment of a room temperature of 30 [° C.] and a humidity of 75 [RH %]. Furthermore, after printing 50,000 sheets, a black half-tone image of the image density of 30% is printed on the sheet members P of A4 size. Moreover, the image density is toner coverage on the sheet member P.

(1) Cleaning Performance

Concentration unevenness of an output image due to cleaning unevenness of the image holder 36 is evaluated. Specifically, the image density of 10 points is randomly measured with respect to the sheet member P on which the half-tone image of the image density of 30% is formed using X-rite 404 (manufactured by X Rite Inc.) and cleaning performance is evaluated from a difference between the maximum value and the minimum value thereof.

A case where the difference between the maximum value and the minimum value is 0.05 or less is "A", a case where the difference between the maximum value and the minimum value is greater than 0.05 and 0.10 or less is "B", and a case where the difference between the maximum value and the minimum value is greater than 0.10 and 0.15 or less is "C". As the difference between the maximum value and the minimum value is small, cleaning unevenness of the image holder 36 is suppressed.

(2) Removing Performance of Contaminants

After evaluating the cleaning performance described above, each image holder 36 is observed and a fixing state of the contaminants such as toner is evaluated. For observation of the image holder 36, a confocal laser microscope (OLS1100, manufactured by OLYMPAS Inc.) is used.

A case where fixing of the contaminants to the image holder 36 is not seen at all is "A" and a case where a ratio of the contaminants on the image holder 36 is 15[%] or less per 1 [$\mu m^2$] is "B". As a method of obtaining the ratio, the ratio of the contaminants is obtained by processing the image that is obtained by imaging the surface of the image holder 36.

Evaluation Result

According to the example, the cleaning performance of the cleaning member 52 is "A" and the removing performance of the contaminants of the cleaning member 52 is "A".

On the other hand, according to the comparison, the cleaning performance of the cleaning member 200 is "C" and the removing performance of the contaminants of the cleaning member 200 is "B".

SUMMARY

As can be seen from the above evaluation, the cleaning performance of the cleaning member 52 with respect to the image holder 36 is improved compared to the case where the contact sections between the elastic member 62 and the image holder 36 are separated from each other in the axial direction.

Furthermore, the helical convex section 64 is formed in the cleaning member 52 by helically winding the strip-shaped elastic member 62 on the shaft member 60. Thus, for example, the helical convex section 64 is easily formed compared to a case where a helical convex section is formed on an outer peripheral surface of an elastic member having a circular cross section.

Furthermore, for the image holder device 50, the cleaning performance with respect to the image holder 36 is improved and thereby degradation of the quality of the image (electrostatic latent image) held in the image holder 36 is suppressed.

Furthermore, for the image forming apparatus 10, degradation of the quality of the electrostatic latent image held in the image holder 36 is suppressed and thereby degradation of the quality of the output image is suppressed.

Configuration of Charging Device

Next, a configuration of the charging device 46 will be described.

As illustrated in FIG. 4, the charging device 46 includes the charging roll 38 as an example of the charging member rotating in an arrow R3 direction and a cleaning member 72 that comes into contact with the charging roll 38 and cleans the outer peripheral surface of the charging roll 38 while rotating by being driven by the rotating charging roll 38.

Furthermore, the charging device 46 includes a support member (not illustrated) as a bearing supporting the charging roll 38 and the cleaning member 72 to be rotatable.

Furthermore, the cleaning member 72 has the same configuration as the cleaning member 52 cleaning the image holder 36 and includes the shaft member 60 and the elastic member 62. Then, in a state where the elastic member 62 is compressed against the outer peripheral surface of the charging roll 38, the elastic member 62 comes into complete contact with the charging roll 38 in the axial direction. Furthermore, the contact pressure of the elastic member 62 becoming large and small with respect to the charging roll 38 is repeated in the axial direction.

Operation of Charging Device

Next, an operation of the charging device 46 will be described.

As illustrated in FIG. 4, the image holder 36 to which rotational force of the motor (not illustrated) is transmitted rotates in the arrow R1 direction. Furthermore, the charging roll 38 is rotated in the arrow R3 direction by being driven by the image holder 36 rotating in the arrow R1 direction. A voltage is applied from power supply (not illustrated) to the charging roll 38 and the charging roll 38 charges the outer peripheral surface of the image holder 36.

Furthermore, in addition, the cleaning member 72 is rotated in an arrow R4 direction by being driven by the charging roll 38 rotating in the arrow R3 direction.

Here, as described above, the contact pressure of the elastic member 62 becoming large and small with respect to the charging roll 38 is repeated in the axial direction. Furthermore, a portion having a high contact pressure and a portion having a low contact pressure are moved in the outer peripheral surface of the charging roll 38 in the axial direction by rotation of the cleaning member 72.

Thus, a force becoming large and small for separating the contaminants fixed to the outer peripheral surface of the charging roll 38 from the outer peripheral surface of the charging roll 38 is repeated. Thus, the cleaning member 72 allows the contaminants fixed to the outer peripheral surface of the charging roll 38 to be separated from the charging roll 38. As described above, the cleaning member 72 cleans the outer peripheral surface of the charging roll 38.

SUMMARY

As can also be seen from the above evaluation result in which the target cleaning member is the image holder 36, in the cleaning member 72, the cleaning performance with respect to the charging roll 38 is improved compared to the case where the contact sections between the elastic member 62 and the charging roll 38 are separated from each other in the axial direction.

Furthermore, for the charging device 46, the cleaning performance with respect to the charging roll 38 is improved and thereby charging unevenness occurring in the outer peripheral surface of the image holder 36 is suppressed.

Furthermore, for the image forming apparatus 10, charging unevenness occurring in the outer peripheral surface of the image holder 36 is suppressed and thereby degradation of the quality of the output image is suppressed.

Figure 7A:
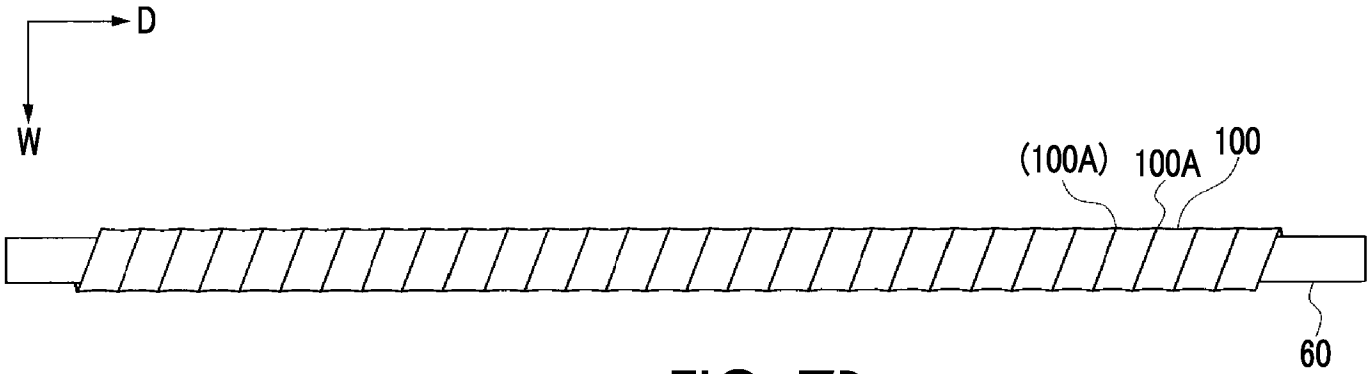
FIGS. 7A and 7B are respectively a front view and an enlarged front view illustrating a modification example of the cleaning member according to the exemplary embodiment of the invention.
Figure 7B:
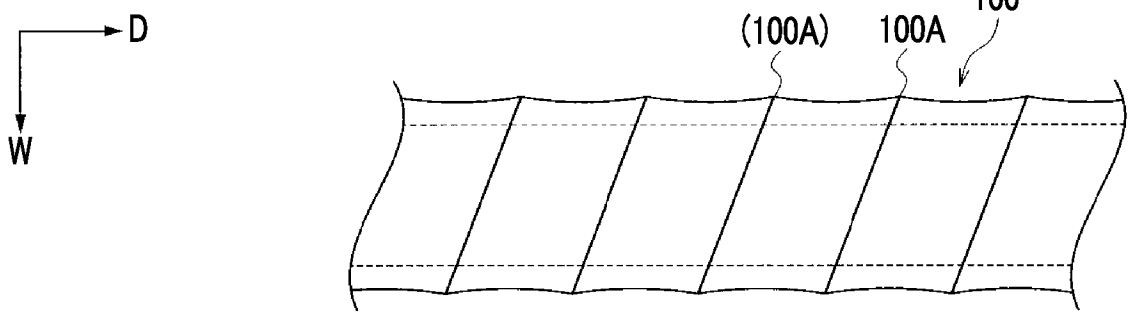

Moreover, although specific exemplary embodiments of the invention have been described in detail, the invention is not limited to the exemplary embodiments and it will be apparent to those skilled in the art that various other exemplary embodiments can be provided within the scope of the invention. For example, in the exemplary embodiments described above, the contact pressure of the elastic member 62 becoming large and small with respect to the image holder 36 and the charging roll 38 is repeated in the axial direction by helically winding the strip-shaped elastic member 62 on the shaft member 60. However, for example, as illustrated in FIGS. 7A and 7B, a helical convex section 100A is formed on an outer peripheral surface of a cylindrical elastic member 100 and thereby a contact pressure becoming large and small may be repeated in an axial direction.

Furthermore, in the exemplary embodiments described above, the image forming apparatus 10 includes the image holder device 50 and the charging device 46, but the image forming apparatus 10 may include at least one of the image holder device 50 and the charging device 46.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a helical convex section formed on an outer peripheral surface;

a shaft member; and an elastic member that is helically wound around an outer peripheral surface of the shaft member, the elastic member having a cross section such that each of two end portions in the width direction are higher than a center portion in the width direction to form the helical convex section, wherein adjacent portions of the elastic member are separated from each other in an axial direction of the shaft member in a state when the elastic member is not compressed against an outer peripheral surface of the a target cleaning member, the elastic member is configured to come into complete contact with the target cleaning member in an axial direction of the target cleaning member in a state when the elastic member is compressed against the outer peripheral surface of the target cleaning member, and the cleaning member is configured to rotate in contact with the target cleaning member rotating around an axis.

2. The cleaning member according to claim 1, wherein the elastic member comes into contact with an outer peripheral surface of the target cleaning member with being compressed against the outer peripheral surface of the target cleaning member.

3. The cleaning member according to claim 1, wherein adjacent elastic members are separated from each other in the axial direction of the shaft member in a state where the elastic members are not compressed against the outer peripheral surface of the target cleaning member.

4. The cleaning member according to claim 1, wherein a contact pressure of the elastic member becoming large and small with respect to an image holder is repeated in the axial direction.

5. The cleaning member according to claim 1, wherein a contact pressure of the elastic member varies between large and small with respect to an image holder and this variation is repeated in the axial direction.

6. The cleaning member according to claim 1, wherein when a circumferential length of a portion in which the elastic member comes into contact with an image holder in a cross section orthogonal to the axial direction is a circumferential length RO, a distance between an outermost point in which the elastic member comes into contact with the image holder on one side in the axial direction and an outermost point in which the elastic member comes into contact with the image holder on the other side in the axial direction is a shaft length ST, and a product of the circumferential length RO and the shaft length ST is an effective contact area M1, the elastic member and the image holder come into contact with each other by 90% or more of the effective contact area M1.

7. An image holder device comprising:

an image holder as a target cleaning member that holds an image; and the cleaning member according to claim 1 that cleans the image holder.

8. A charging device comprising:

a charging member as a target cleaning member that charges an image holder; and the cleaning member according to claim 1 that cleans the charging member.

9. The cleaning member according to claim 1, wherein the adjacent portions of the elastic member contact each other in the state when the elastic member is compressed against the outer peripheral surface of the target cleaning member.

* * * * *